US007891035B2

(12) United States Patent
Howley et al.

(10) Patent No.: US 7,891,035 B2
(45) Date of Patent: Feb. 22, 2011

(54) ARTICLE OF FOOTWEAR HAVING A WORN APPEARANCE AND METHOD OF MAKING SAME

(75) Inventors: Joe Howley, Lake Oswego, OR (US); Richard D. Clarke, Portland, OR (US); Jesse Leyva, Beaverton, OR (US); Steven E. J. C. Ploem, Bangkok (TH)

(73) Assignee: NIKE, Inc., Beaverton, OR (US)

( * ) Notice: Subject to any disclaimer, the term of this patent is extended or adjusted under 35 U.S.C. 154(b) by 945 days.

(21) Appl. No.: 11/742,728

(22) Filed: May 1, 2007

(65) Prior Publication Data

US 2008/0271265 A1 Nov. 6, 2008

(51) Int. Cl.
*A43D 11/00* (2006.01)
*A43D 21/00* (2006.01)

(52) U.S. Cl. ..... 12/142 R; 12/146 B; 12/146 C; 36/136

(58) Field of Classification Search ..... 36/45, 36/25 R, 136, 47; 12/142 R, 146, 146 B, 12/146 BR, 146 C
See application file for complete search history.

(56) References Cited

U.S. PATENT DOCUMENTS

| | | | | |
|---|---|---|---|---|
| 1,439,743 | A | 12/1922 | Mathes | |
| 3,440,672 | A | 4/1969 | Fromantin | |
| 3,986,824 | A | 10/1976 | Waibel et al. | |
| 4,218,220 | A | 8/1980 | Kappler et al. | |
| 4,575,887 | A | 3/1986 | Viramontes | |
| 4,740,213 | A | 4/1988 | Ricci | |
| 4,816,033 | A | 3/1989 | Hoffer et al. | |
| 4,845,790 | A | 7/1989 | Brasington | |
| 4,852,990 | A * | 8/1989 | Patterson | 8/108.1 |
| 4,997,450 | A * | 3/1991 | Olson et al. | 8/109 |
| 5,019,131 | A * | 5/1991 | Nitsch, Jr. | 8/457 |
| 5,082,468 | A | 1/1992 | Hopkins | |
| 5,114,426 | A * | 5/1992 | Milora et al. | 8/102 |
| 5,213,581 | A * | 5/1993 | Olson et al. | 8/401 |
| 5,298,316 | A * | 3/1994 | Coughlin | 442/148 |
| 5,325,611 | A | 7/1994 | Dyer et al. | |
| 5,369,830 | A | 12/1994 | Chiarabini Bravi | |
| 5,435,809 | A | 7/1995 | Holst et al. | |
| 5,505,739 | A | 4/1996 | Montesano | |
| 5,558,676 | A | 9/1996 | Gray et al. | |
| 5,653,770 | A | 8/1997 | Goldstein et al. | |

(Continued)

FOREIGN PATENT DOCUMENTS

| | | |
|---|---|---|
| JP | 06-014804 | 1/1994 |

OTHER PUBLICATIONS

International Search Report and Written Opinion, mailed Aug. 26, 2008, from PCT Application No. PCT/US2008/056815.

*Primary Examiner*—Marie Patterson
(74) *Attorney, Agent, or Firm*—Plumsea Law Group, LLC

(57) ABSTRACT

An article of footwear made from new or substantially new materials is manufactured with vintage treatment processing to give the article of footwear a vintage or well-worn appearance. The article of footwear may be treated with discoloring substances, such as dyes or bleaching agents. The upper may be formed with wrinkles or a crushed heel portion, such as by using a thin or soft foam behind a polyester covering, eliminating the foam backing and/or heel cup. Further, a rubber outsole may be molded with uneven treads and/or discolored to give the rubber a degraded, worn appearance.

26 Claims, 6 Drawing Sheets

U.S. PATENT DOCUMENTS 5,843,268 A 12/1998 Lyden et al.
5,990,444 A * 11/1999 Costin ..... 219/121.69
6,252,196 B1 * 6/2001 Costin et al. ..... 219/121.69
6,638,993 B2 * 10/2003 Patel et al. ..... 523/122
6,685,868 B2 * 2/2004 Costin ..... 264/400
6,702,861 B2 3/2004 Trask et al.
6,878,407 B2 4/2005 Park
6,916,348 B2 * 7/2005 Fennen et al. ..... 8/437
7,014,662 B1 3/2006 Mei et al.
7,427,299 B2 * 9/2008 Ziakas ..... 8/114.6
2002/0133261 A1 9/2002 Fard
2004/0067322 A1 * 4/2004 Baker et al. ..... 427/421
2005/0065058 A1 * 3/2005 Roselle et al. ..... 510/475
2005/0065059 A1 * 3/2005 Roselle et al. ..... 510/475
2006/0143770 A1 7/2006 Ziakas

* cited by examiner

ARTICLE OF FOOTWEAR HAVING A WORN APPEARANCE AND METHOD OF MAKING SAME

BACKGROUND OF THE INVENTION

1. Field of the Invention

The present invention relates generally to articles of footwear. More particularly, the invention relates to manufacturing new articles of footwear to resemble vintage or worn articles of footwear.

2. Description of Related Art

Vintage clothing and accessories are popular items, with true vintage articles commanding high retail prices when these rare items become available for sale. To fill the need for the vintage look, manufacturers reissue designs. However, the vintage market also includes a high demand for articles which not only incorporate the vintage styles, but which also look used, with wear patterns, creasing, and discoloration to give the appearance of a well-worn article. This vintage market has been dominated by denim, with many treatments having been devised to make jeans and jackets look "broken in" and worn.

Recently, a similar trend has developed for used athletic shoes, such as sneakers from the 1970s and 1980s. Truly vintage articles of footwear, with vintage wear characteristics such as discoloration, worn tread patterns, wrinkles, and creases may command high prices. Even if a person is willing to pay such high prices for used footwear, such articles of footwear are rare.

Some footwear manufacturers have attempted to accommodate this fashion trend by producing new articles of footwear with some vintage characteristics. In some methods, materials used in making the upper may be given a vintage treatment prior to constructing the article of footwear. In one such example, U.S. Pat. No. 6,878,407 discusses manipulating leather or suede by passing the fabric over substance-infused rollers then ironing the fabric to set the substances and them selectively abrading the fabric. The distressed fabric may then be used to make a shoe or portion of a shoe. Similarly, Japanese patent number JP 6014801 discloses distressing leather or suede materials by impregnating the material with a pigment-laden resin, then selectively abrading portions of the resin from the surface by washing the material with pumice. The materials are attached to an instep material either before or after washing the material with the pumice.

In other treatments, old materials may be used to form new articles of footwear. For example, U.S. Pat. No. 5,369,830 discloses recycling old tires by making outsoles from the rubber of the tires. These outsoles are attached to uppers made from new, eco-friendly materials.

However, it is not known in the art to produce an article of footwear from new or substantially new materials to give the article of footwear a well-worn appearance. Therefore, there exists a need in the art for methods to produce new articles of footwear which resemble vintage articles of footwear in both styling and wear patterns.

SUMMARY OF THE INVENTION

The invention provides a method of making a new article of footwear having a vintage appearance. In one aspect, the invention provides a method of making an article of footwear comprising the steps of: (i) making an upper of the article of footwear using new or substantially new materials; (ii) making a sole of the article of footwear using new or substantially new materials; (iii) treating at least one of the upper and the sole to with a substance to give the article of footwear a worn appearance; and (iv) assembling the article of footwear by attaching the upper to the sole.

In another aspect, step (iii) comprises applying the substance to an outer surface of the material of the upper or sole.

In another aspect, the substance is applied to the outer surface by hand.

In another aspect, the substance applied to the outer surface is a bleaching agent.

In another aspect, the substance comprises chlorine.

In another aspect, the substance comprises a dye.

In another aspect, the material comprises at least one of a leather material, cotton, foam, and a synthetic material.

In another aspect, the synthetic material comprises polyester.

In another aspect, the leather material comprises leather, suede, or vinyl.

In another aspect, step (iv) occurs prior to step (iii).

In another aspect, step (iii) occurs simultaneously with one of step (i) or step (ii).

In another aspect, the invention further comprises the step of abrading a portion of the new or substantially new materials.

In another aspect, the invention further comprises the step of deforming the article of footwear.

In another aspect, deforming the article of footwear includes crushing the upper.

In another aspect, the invention provides a method of making an article of footwear comprising the steps of: (i) making an upper of the article of footwear using new or substantially new materials; (ii) making a sole of the article of footwear using new or substantially new materials; (iii) marring at least one of the upper and the sole to give the article of footwear a worn appearance; and (iv) assembling the article of footwear by attaching the upper to the sole.

In another aspect, step (iii) comprises attaching a material to a backing so that the material wrinkles.

In another aspect, the material comprises a synthetic material.

In another aspect, the backing comprises a foam material.

In another aspect, step (iii) comprises abrading a portion of at least one of the upper and the sole.

In another aspect, step (iii) comprises deforming the article of footwear.

In another aspect, deforming the article of footwear includes crushing the upper.

In another aspect, step (iii) comprises discoloring at least a portion of the article of footwear.

In another aspect, discoloring the article of footwear includes bleaching the portion of the article of footwear.

In another aspect, discoloring the article of footwear includes darkening the portion of the article of footwear.

In another aspect, step (iii) occurs prior to at least one of steps (i), (ii), and (iv).

In another aspect, step (iii) occurs simultaneously with at least one of steps (i), (ii), and (iv).

In another aspect, the invention provides an article of footwear comprising an upper, a sole connected to the upper, the sole including an outsole and a midsole. The upper and the sole are made from new or substantially new materials, and the upper and the sole each have at least one vintage characteristic.

In another aspect of the invention, the upper is made from a combination of natural and synthetic materials.

In another aspect, the outsole is made from rubber treated with titanium dioxide.

In another aspect, the outsole includes at least one tread formed to have a wear pattern.

In another aspect, a discoloring agent is applied to the upper and midsole.

In another aspect, the discoloring agent is dye or bleach.

In another aspect, a portion of the upper or the sole is abraded.

In another aspect, a portion of the upper is stonewashed.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
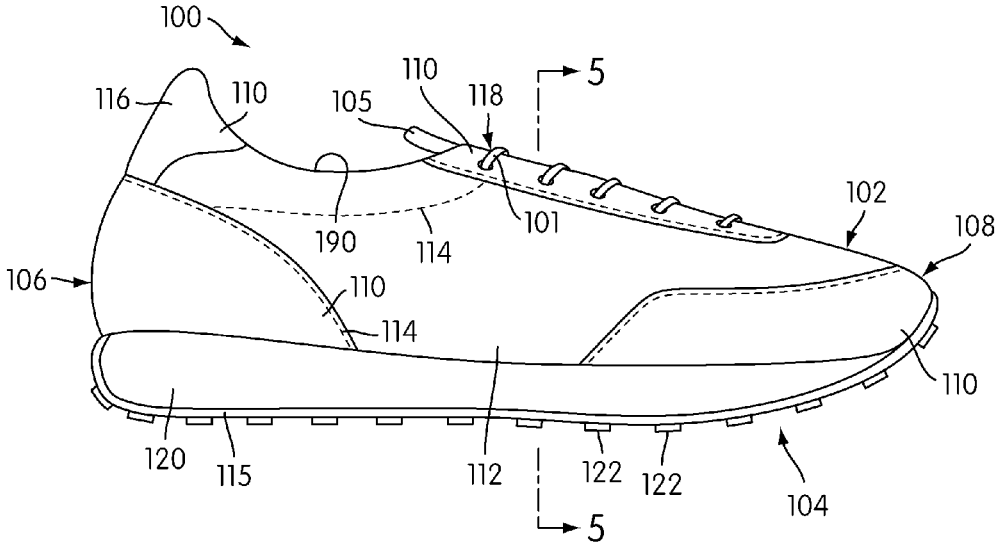
FIG. 1 is a schematic side view of a preferred embodiment of an article of footwear prior to vintage treatment.

In one embodiment, an article of footwear is manufactured from new or substantially new materials and then treated to take on a vintage or well-worn appearance. FIG. 1 is a schematic view of an article of footwear 100 after assembly but prior to vintage treatment. In one embodiment, article of footwear 100 includes an upper 102 affixed to a sole 104.

Upper 102 preferably includes a heel portion 106 and a toe portion 108 which are configured to receive and substantially enclose a foot, although in other embodiments upper 102 may not substantially enclose the foot. For example, upper 102 may form a sandal, mule, or similar type of footwear. Additionally, upper 102 preferably includes a foot insertion portion or throat opening 190, such as an adjustable opening which can surround the ankle. The size of throat opening 190 may be adjusted by a closing system 118, which may be tightened or loosened by manipulating a connector 101, shown in FIG. 1 as a lace, but which may be any type of connector, such as a zipper or a hook-and-eye system, such as Velcro®. A tongue 105 is preferably included with upper 102 and positioned beneath lacing portion 118.

Upper 102 may be made from a plurality of materials, including both natural materials, such as woven cotton, leather, and leather-like materials such as suede, and synthetic materials, such as polyester, foam, vinyl, or similar materials. Preferably, upper 102 is made from more than one material. For example, as shown in FIG. 1, upper 102 includes a main body 112. Body 112 is preferably made with a sandwich construction, with an outer layer 126 made from a flexible material, such as woven polyester or cotton. Preferably, outer layer 126 is backed by a foam layer 128, and a relatively stiff instep layer 130.

Reinforcement patches 110 may be attached to body 112 to reinforce at least one of heel region 106, ankle region 116, lacing region 118, and toe region 108. Preferably, reinforcement patches 110 are made of natural or synthetic wear-resistance materials, such as suede, leather, and vinyl.

In this embodiment, prior to vintage treatment, upper 102 may be made by any conventional method, such as by forming the individual elements of upper 102 such as main body 112 and reinforcing elements of heel region 106, lacing region 107, and toe region 108, and attaching the individual elements together. The individual elements of upper 102 may be formed by cutting from patterns, molding synthetic portions, or the like. The individual elements of upper 102 may be attached to each other by sewing, gluing, heat setting, or any other method used. Preferably, as shown in FIG. 1, reinforcement patches 110 have been stitched to body 112 with stitches 114.

Figure 2:
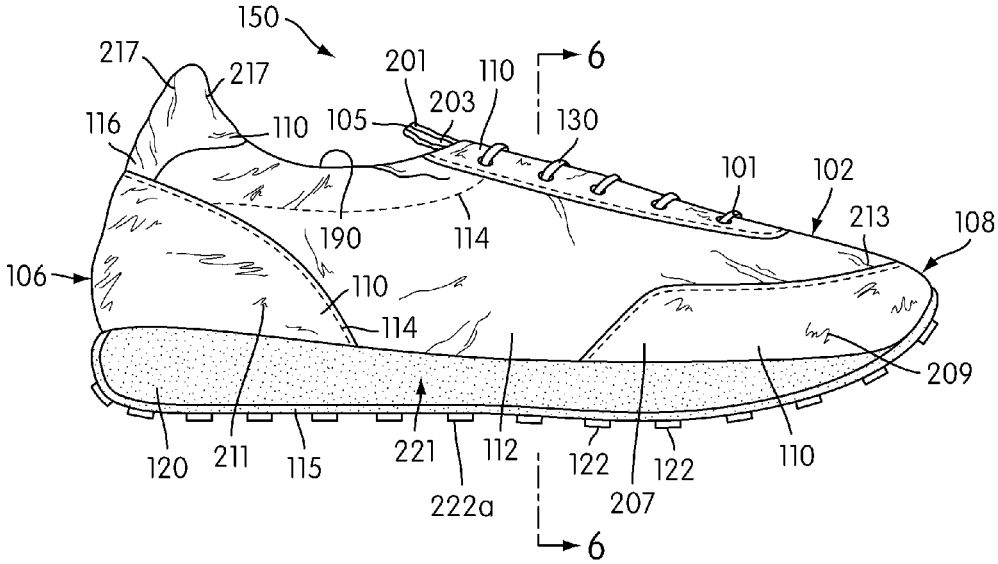
FIG. 2 is a schematic side view of the article of footwear of FIG. 1 after vintage treatment.

FIG. 2 shows an embodiment of article of footwear 150 after vintage treatment. In this embodiment, both upper 102 and sole 104 have been treated to give both portions a vintage or well-worn look. Vintage treatment entails providing any of a number of characteristics typical of articles of footwear which have been worn for an extended period of time. For example, an athletic shoe may be worn on a daily basis for a number of months or even a year. During this time, the shoe would be exposed to a number of soiling or staining and discoloring factors, including but not limited to dirt and mud from streets or athletic fields, chewing gum, tar, water such as from rain, and sunlight. Additionally, the shoe would be exposed to wearing or abrading factors which would crush or wear away portions of the material of upper 102 or sole 104. Such wearing or abrading factors include inserting a foot into the shoe, which tends to crush the heel, walking or running on hard surfaces, which compresses sole 104 and wears outsole and treads, flexing the shoe during walking or running, which distorts and wrinkles upper 102, scraping the shoe on a hard surface, which may scratch the material of upper 102. Additional wearing factors not listed here could also create wear patterns on the shoe.

Article of footwear 150 reflects a number of different characteristics that give article of footwear 150 the appearance of having been exposed to the discoloring and abrading factors discussed above. For example, on upper 102, body 112 includes wrinkles 213. Ankle portion 116 includes creases 217. All of the sections of upper 102 include discoloration markings, such as darkened areas 209 to reflect exposure to dirt, lightened areas 207 to simulate bleaching due to sun exposure or the wearing or washing away of dyes, and dark spots 211 to simulate stains from sticky substances such as tar and chewing gum.

Figure 3:
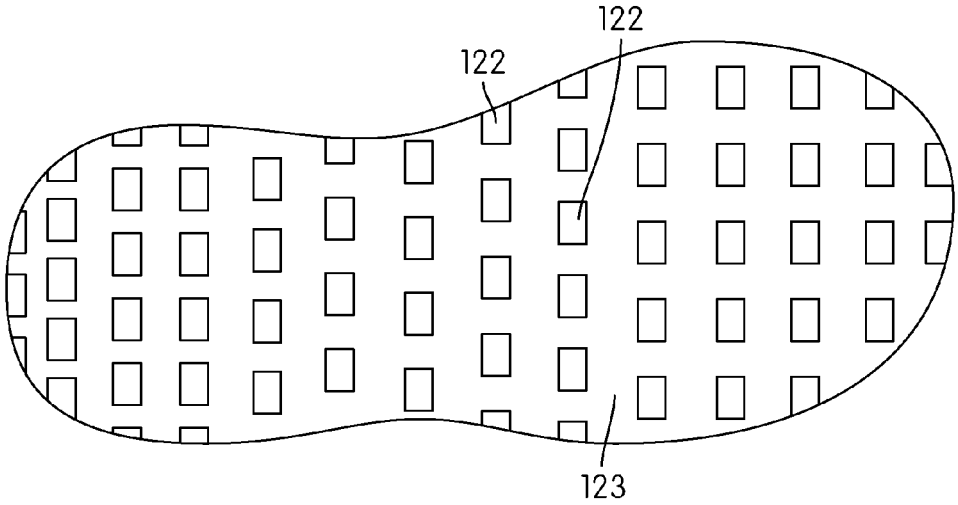
FIG. 3 is a schematic bottom plan view of an outsole of an article of footwear without vintage treatment.
Figure 4:
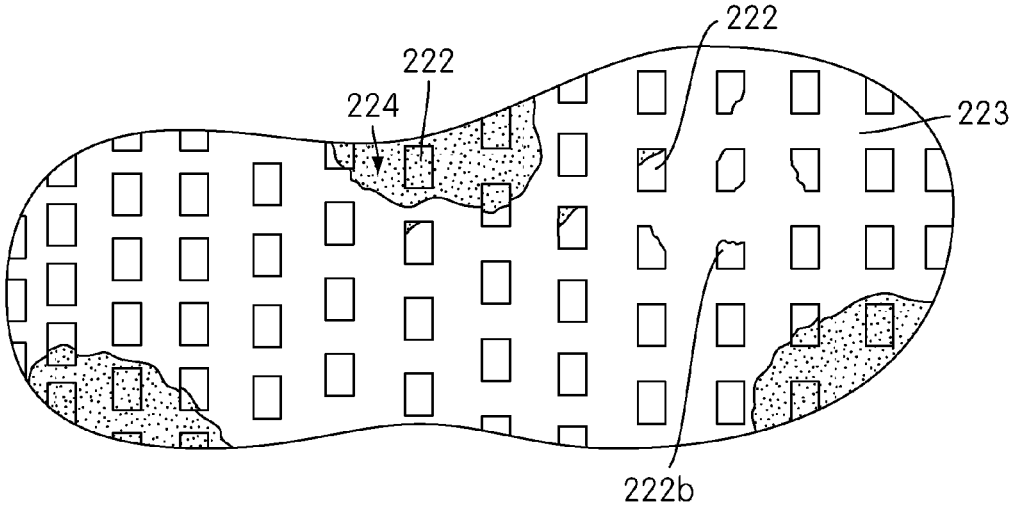
FIG. 4 is a schematic bottom plan view of a preferred embodiment of an outsole of an article of footwear with vintage treatment.

Sole 104 also includes darkened areas 221 to simulate exposure to dirt and other discoloring substances. Further, outsole 115 is subject to wear patterns over time. As shown in FIG. 3, a new outsole, formed of a resilient material such as natural or synthetic rubber, includes a flat surface 123 from which a number of projections or treads 122 protrude. Each tread 122, shown here as square or rectangular, may have any shape known in the art. In most new articles of footwear, each tread is approximately uniform in at least one dimension, such as having the same height. In vintage articles of footwear, however, the uniformity of treads is diminished. Treads 122 may be given an uneven appearance, such as by altering the height, as shown by tread 222*a* in FIG. 2, or eliminating portions of treads, such as tread 222*b* in FIG. 4 to simulate wear patterns such as pivoting on the balls of the feet. Further, rubber tends to take on an ashen appearance over time. As shown in FIG. 4, outsole 115 may be whitened or grayed so that the rubber material looks like it is breaking down due to age or exposure to the elements.

In a preferred embodiment, all of these vintage features are included on article of footwear 150. However, in other embodiments, one or more of these vintage features may be eliminated. For example, in one embodiment, only one vintage characteristic may be provided in each of upper 102 and sole 104. In some embodiments, only upper 102 has been treated to achieve a vintage appearance, and in other embodiments, only sole 104 has been treated.

Figure 7:
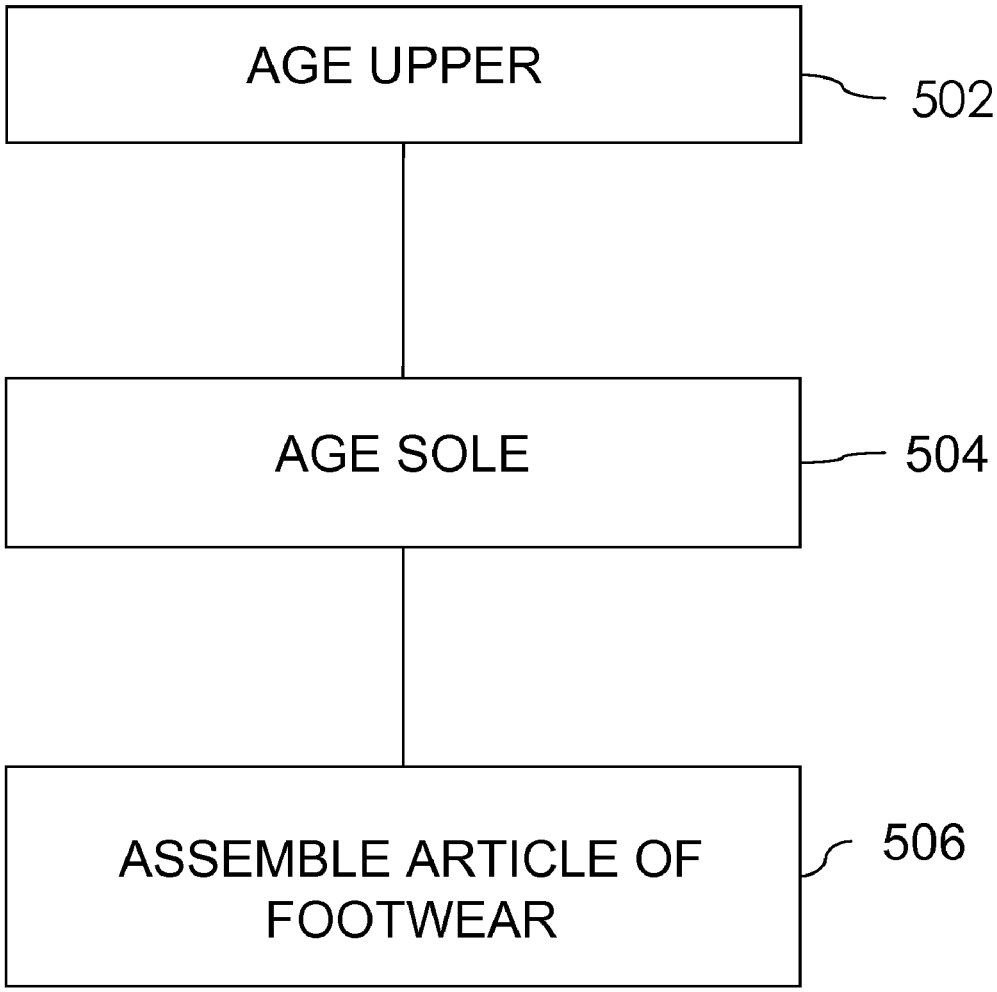
FIG. 7 is a flow chart of the overall vintage treatment process.

The vintage features as discussed above may be imparted to article of footwear 150 via a number of different processes which entail marring article of footwear 150, i.e., making a physical change to the material or construction of article of footwear 150. FIG. 7 is a flowchart of a preferred embodiment of a possible vintage treatment process 500. In this embodiment, step 502 includes a step for aging an upper, such as upper 102 shown in FIG. 1. Step 504 includes a step for aging a sole, such as sole 104 shown in FIG. 1. In step 506, the article of footwear is assembled by forming upper 102, forming sole 104, and/or attaching upper 102 to sole 104. These steps may be performed in any order. For example, in one embodiment, step 506 follows steps 502 and 504. In another embodiment, step 506 may precede one or both of steps 502 and 504, as article of footwear 150 may be assembled partially or entirely prior to giving any portion of article of footwear 150 vintage treatment. Additionally, in other embodiments, various steps may be eliminated, such as by performing step 502 to age upper 102 but not performing step 504 to age sole 104 or vice versa.

Figure 8:
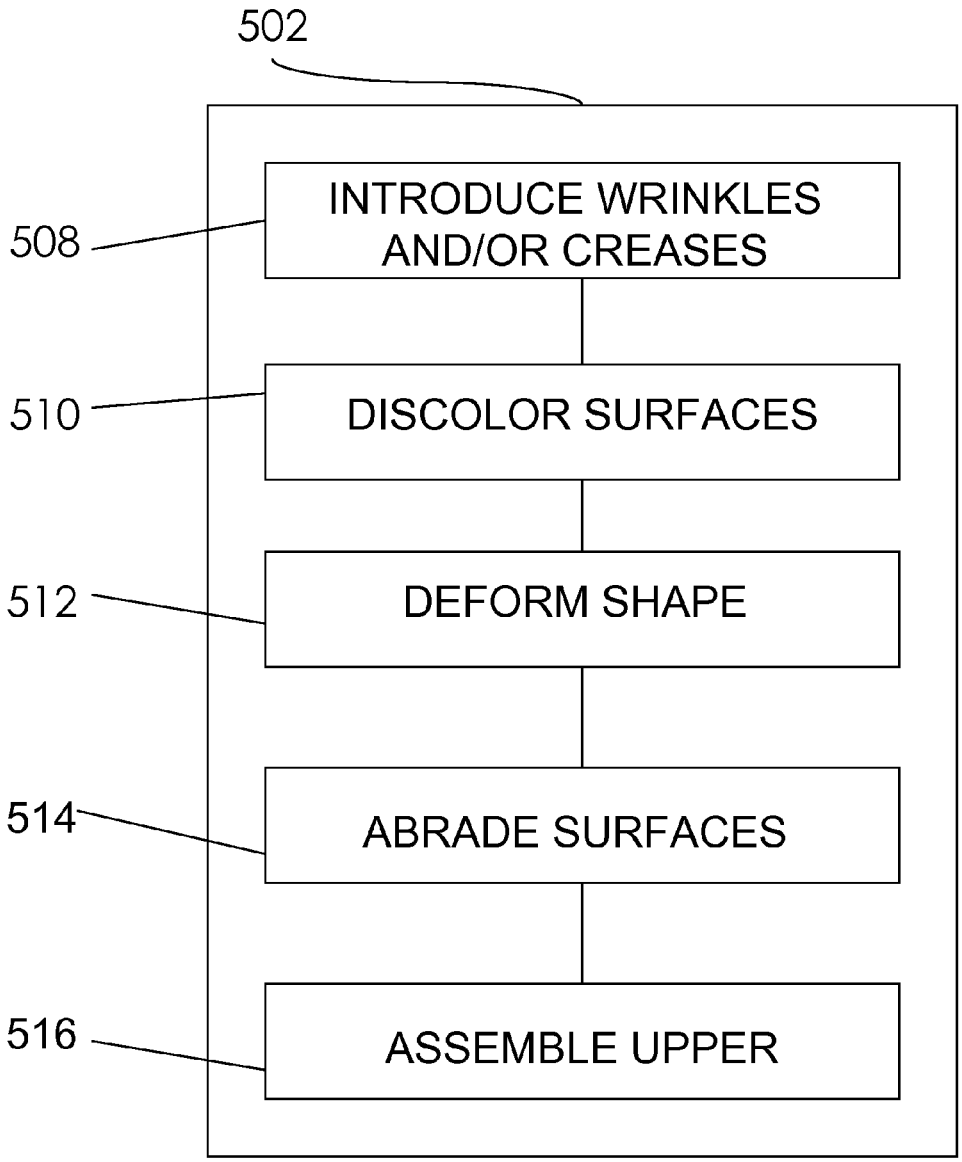
FIG. 8 is a flow chart of the vintage treatment process for an upper.

As shown in FIG. 8, step 502 of aging upper 102 may employ several different steps, depending upon the type of materials used to make upper 102 and the vintage characteristics desired to be imparted to upper 102. Step 508 includes introducing wrinkles and/or creases to the material of upper 102. For example, in typical athletic wear, walking or running causes upper 102 to flex, which folds the material of upper 102. Over time, this repeated flexing causes the material of upper 102 to develop wrinkles or creases. Wrinkles, such as wrinkles shown in FIG. 2, tend to develop in uppers formed from cloth fabrics stitched together.

Figure 5:
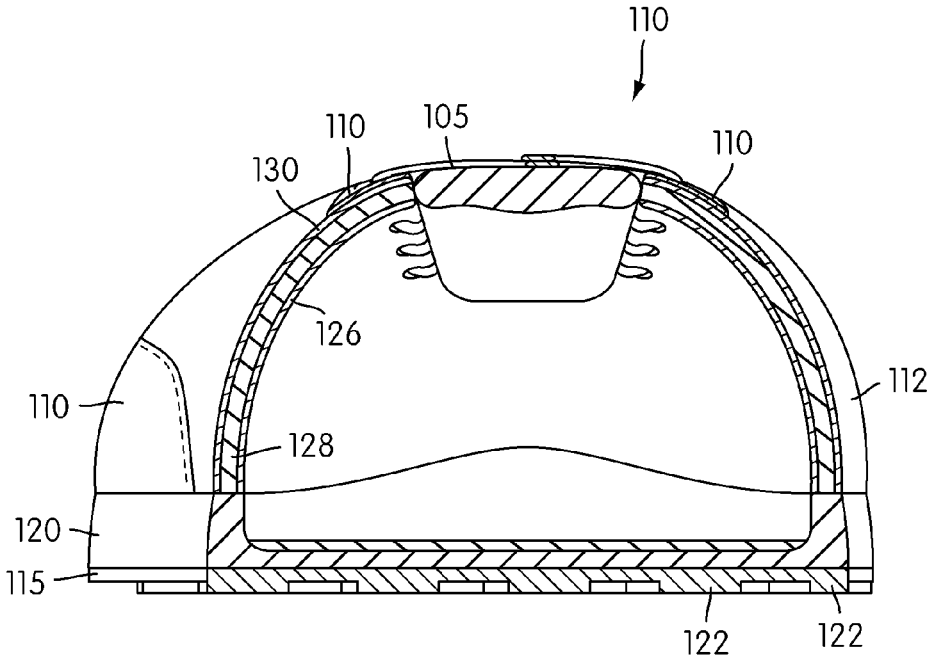
FIG. 5 is a schematic cross-sectional view of the article of footwear of FIG. 1, taken along line 5-5 in FIG. 1.

For example, as shown in FIG. 5, body 112 is preferably formed from an outer layer 126 attached by stitching to a relatively stiff instep material layer 130 with a layer of foam 128 sandwiched between outer layer 126 and instep material 130. When originally made, foam 128 has a first thickness which fills out outer layer 126 to prevent wrinkling from the compression of the stitches. However, as upper 102 is flexed over time, foam 128 compresses due to the mechanical action of the foot. Eventually, foam 128 is no longer capable of resuming its original thickness. As a result, wrinkles form in outer layer 126.

Figure 6:
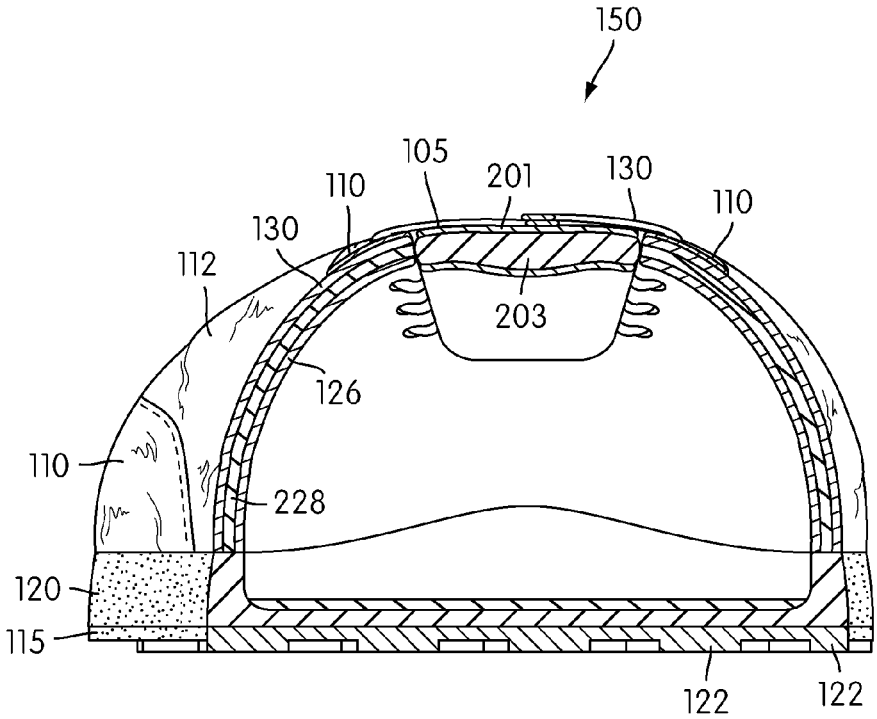
FIG. 6 is a schematic cross-sectional view of the article of footwear of FIG. 2, taken along line 6-6 in FIG. 2.

To simulate the wrinkling of outer layer 126 in a new article of footwear, foam 128 may be eliminated from upper 102. Alternatively, as shown in FIG. 6, a thin layer of foam 228 may be used which is not able to completely fill out outer layer 126. As a result, when outer layer 126 and foam 228 are stitched to instep material 128, wrinkles form in outer layer 126. In other embodiments, similar wrinkles would result in a natural material, such as cotton or leather, also backed by a thin layer of foam or no foam.

In other embodiments, the material desired to be affected is a leather material or leather-like material, such as suede or vinyl. While materials such as leather wrinkle like thinner, more flexible fabrics, leather also develops creases, such as creases 217 shown in FIG. 2. Creases can be developed in the leather prior to attaching the leather to instep material 130, such as by folding the material and ironing the folded leather. Creases may also be formed in the leather after the leather is attached to instep material 130, such as by passing a roller over the material under heavy pressure.

In step 510, upper 102 is discolored. Discoloration of the surface of an article of footwear is due to exposure to soiling elements, such as dirt and mud, or to bleaching agents, such as water which may wash away dyes or sunlight which fades materials. Over time, an article of footwear develops unique discoloration patterns, such as darkened areas 209 and lightened areas 207 in FIG. 2.

To simulate these patches of lightened areas and darkened areas, a substance such as a dye to darken the material or a bleaching agent to lighten the material may be applied to the surface. The substance is preferably wiped onto the surface of upper 102 by hand so that each article of footwear 150 has a unique pattern of darkened and lightened patches. However, the substance may also be sprayed or otherwise applied to upper 102 using an automated system. Examples of dyes include analine dyes and dyestuffs and analine pigments, and the like. Examples of bleaching agents include chlorine, ammonium persulfate, and the like.

Step 512 entails deforming the shape of upper 102. In most newly manufactured articles of footwear, the upper is relatively stiff, with internal reinforcements that assist the upper in maintaining its given shape. For example, many uppers include a stiff instep material and/or a heel counter to maintain the shape of the upper. However, via normal wear and tear, these materials break down, giving the upper a crushed appearance.

As shown in FIG. 2, the crushed appearance of a vintage upper may be simulated in upper 102. Upper 102 may be formed, and then crushed, such as by crushing heel region 106 in a press, such as a hydraulic or pneumatic press. Alternatively, the heel counter may be eliminated entirely. In yet another embodiment, the heel counter is eliminated and heel region 106 is crushed.

Step 514 entails abrading the surface of upper 102. In vintage articles of footwear, the upper has been worn extensively. Over time, the upper may be rubbed against rough or abrasive surfaces, such as concrete, brick, or the like. This rubbing action scratches the material of the upper, leaving thinned or marred patches. Also, the tongue of the article of footwear is rubbed on a more continual basis during wear, such as against the leg or pants of the wearer, or against the laces when the article of footwear is being tightened around the foot, or against the hand of the wearer as the tongue is adjusted for insertion of the foot into the upper. These rubbing actions cause the outer layer of material to be worn, sometimes splitting entirely.

These abrading effects are simulated in one embodiment by scratching upper 102 with an abrading material, such as sandpaper, a grinding wheel, pumices stones, or the like. For example, in one embodiment, as shown in FIG. 2, an outer layer 201 of material of tongue 105 of upper 102 may be abraded along a perimeter so that an internal layer 203 of foam is exposed. In other embodiments, additional areas of upper 102, such as reinforcement patches 110, may be abraded to achieve a desired worn affect.

In embodiments using leather as an upper material, traditional stonewashing techniques may be used to abrade the leather to produce a worn appearance in step 514. For example, in one embodiment, prior to forming upper, the leather material may be tumbled with granules of rock, such as pumice, to physically abrade the material. The granules may be wetted or dry. To enhance the effect, the leather material may then be washed in a heavy bleach solution. Alternatively, in another embodiment, the pumice granules may be impregnated with a bleaching agent so that the leather material is bleached and abraded simultaneously. In other embodiments, the upper may be formed prior to tumbling with rock granules and/or bleaching agents.

Step 516 is assembling upper 102. Upper 102 may be assembled using any conventional method, such as providing all of the constituent pieces of material, shaping upper 102 on a last having the desired shape and size, and then attaching the constituent pieces of material together. The constituent pieces may be attached using any method known in the art, such as by stitching, with an adhesive, or other similar processes.

It will be apparent that any of steps 508, 510, 512, and 514 may be eliminated in alternate embodiments. In some embodiments, only one of steps 508, 510, 512, and 514 may be included. If more than one of these steps is used to provide vintage treatment to upper 102, these steps may be performed in any order. Also, step 516, assembling upper 102, may be performed at any stage, for example, prior to any of the vintage treatment steps, after vintage treatment steps, or simultaneously with at least one of the vintage treatment steps.

Figure 9:
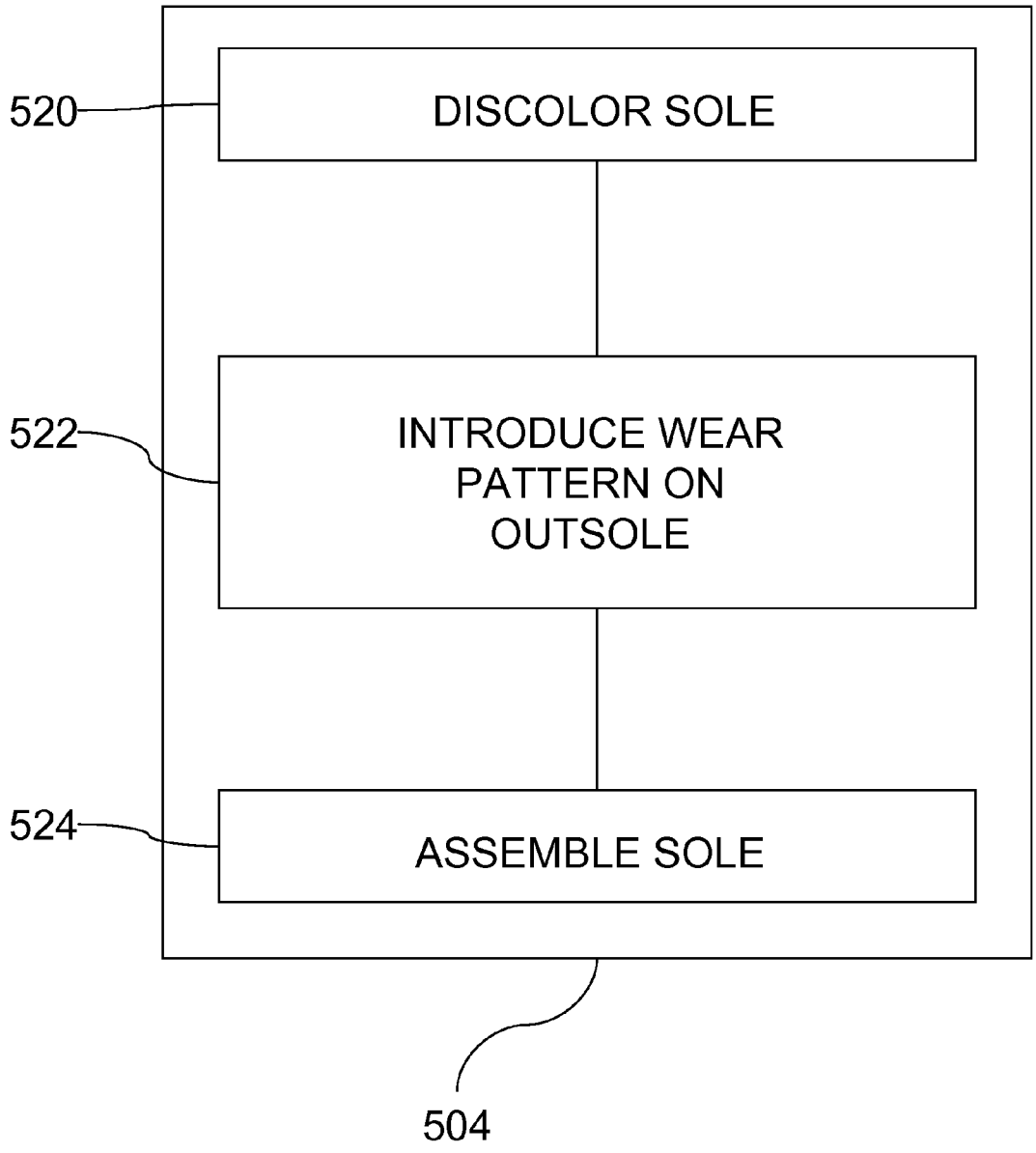
FIG. 9 is a flow chart of the vintage treatment process for the sole.

FIG. 9 lists various vintage treatments that may be performed to in step 504 in FIG. 7. In step 520, sole 104, which may include both an outsole portion and midsole portions, may be discolored. In normal wear and over time, the sole of an article of footwear is stained by dirt, mud, and other discoloring agents with which the sole comes into contact. These stains are shown as darkened patches 221 in FIG. 2. Darkened patches 221 may be simulated on new article of footwear 150 by applying a darkening discoloring agent to both midsole 120 and outsole 123. Preferably, the discoloring agent is a dye which may be applied to the surface of sole 104. In one embodiment, the dye is methyl ethyl ketone (MEK), analine dyes and dyestuffs, analine pigments, and the like. Preferably, the discoloring agent is applied to sole 104 by hand, although it may be applied in an automated fashion, such as by spraying.

In another embodiment, outsole 123 is made of a rubber or rubber-like material. Over time, an outsole material such as rubber may degrade due to age, exposure to corrosive elements such as salt and other ice-melting materials, and the like. In such circumstances, the rubber material takes on an ashen appearance, with patches of white and gray formed on outsole, such as ashen patches 224 shown in FIG. 4. While the discoloring agent may be a dye applied to the surface as described above, preferably the discoloring agent is co-molded with the material of outsole 123. For example, if outsole 123 is made of rubber, then titanium dioxide, in powder, liquid, or gel form, or similar whitening substance may be strategically added to the mold prior to the introduction of the rubber material to the mold. Alternatively, the whitening substance may be mixed into a solution and applied to sole 104 by any method known in the art, such as by wiping or painting the solution onto sole 104 and allowing the whitening solution to dry. As sole 104 is worn, the whitening substance may wear off, making sole 104 look newer over time. In addition to titanium dioxide, any whitening or discoloring agent known in the art may be used, such as zinc oxide or the like.

Another characteristic typical of vintage articles of footwear are the wear patterns on the outsole, for example where tread elements or portions of tread elements have been worn away through contact with hard surfaces. As shown in FIG. 4, worn tread elements 222*b* can assume irregular edges. Also, as shown in FIG. 2, the height of worn tread elements 222*a* can be lower than unworn tread elements, or of uneven height. The mold for outsole 123 could be formed to include such uneven tread elements, particularly in areas of the outsole which are commonly worn down, such as on the balls of the feet or the heel striking point.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of making an article of footwear comprising the steps of:

(i) assembling an upper of the article of footwear using new or substantially new materials, wherein the upper is assembled in part by shaping the upper on a last to provide the upper with a desired size and shape;

(ii) making a sole of the article of footwear using new or substantially new materials;

(iii) assembling the article of footwear by attaching the upper to the sole; and (iv) after the steps of assembling the article of footwear, treating the upper with a substance to give the article of footwear a worn appearance, wherein the substance comprises an agent to lighten the material, and wherein the substance is applied to only a portion of the upper to create a lightened patch on the surface of the upper.

2. The method according to claim 1 further comprising the step of applying a second substance to a second portion of an outer surface of the upper to create a darkened patch.

3. The method according to claim 1, wherein the substance is applied to the outer surface by hand.

4. The method according to claim 1, wherein the agent to lighten the material includes a bleaching agent.

5. The method according to claim 4, wherein the substance comprises chlorine.

6. The method according to claim 2, wherein the second substance comprises a dye, and wherein the dye is applied to a portion of the article of footwear to discolor the new or substantially new material in spots to simulate a stain from a sticky substance.

7. The method according to claim 1, wherein the material comprises at least one of a leather material, cotton, foam, and a synthetic material.

8. The method according to claim 1, wherein the material comprises polyester.

9. The method according to claim 1, wherein the material comprises at least of leather, suede, and vinyl.

10. The method according to claim 1, wherein the step of making an upper comprises attaching a material to a backing.

11. The method according to claim 10, wherein the backing comprises a foam material.

12. The method according to claim 1, further comprising the step of abrading a portion of the new or substantially new materials.

13. The method according to claim 1, further comprising the step of deforming the article of footwear.

14. The method according to claim 13, wherein deforming the article of footwear includes crushing the upper.

15. A method of making an article of footwear comprising the steps of:

(i) making an upper of the article of footwear using new or substantially new materials;

(ii) making a sole of the article of footwear using new or substantially new sole materials, wherein the new or substantially new sole materials comprise at least one of leather, vinyl, foam, natural rubber, and synthetic rubber;

(iii) marring only a portion of the sole to give the article of footwear a degraded appearance with vintage characteristics; and (iv) assembling the article of footwear by attaching the upper to the sole.

16. The method according to claim 15, wherein step (i) comprises attaching a material to a backing so that the material wrinkles.

17. The method according to claim 16, wherein the material comprises a synthetic material.

18. The method according to claim 17, wherein the backing comprises a foam material.

19. The method according to claim 15, wherein step (iii) comprises abrading the portion of the sole.

20. The method according to claim 15, further comprising deforming the article of footwear.

21. The method according to claim 20, wherein deforming the article of footwear includes crushing the upper.

22. The method according to claim 15, wherein step (iii) comprises discoloring the portion of the sole.

23. The method according to claim 22, wherein discoloring the portion of the sole includes bleaching the portion of the sole.

24. The method according to claim 22, wherein discoloring the portion of the sole includes darkening the portion of the sole.

25. The method according to claim 15, wherein step (iii) occurs prior to at least one of steps (i), (ii), and (iv).

26. The method according to claim 15, wherein step (iii) occurs simultaneously with at least one of steps (i), (ii), and (iv).

* * * * *